US005921466A

United States Patent [19]

Speese et al.

[11] Patent Number: 5,921,466

[45] Date of Patent: Jul. 13, 1999

[54] STACKABLE, FOLDABLE FOOD CONTAINER

[75] Inventors: Scott Speese, Oshtemo; David M. Hanna, Augusta, both of Mich.

[73] Assignee: Arvco Container Corporation, Kalamazoo, Mich.

[21] Appl. No.: 09/191,617

[22] Filed: Nov. 13, 1998

[51] Int. Cl.[6] ..... B65D 5/22

[52] U.S. Cl. ..... 229/114; 229/149; 229/178; 229/902

[58] Field of Search ..... 229/114, 149, 229/151, 154, 178, 902, 906

[56] References Cited

U.S. PATENT DOCUMENTS

| | | | |
|---|---|---|---|
| 1,725,524 | 8/1929 | Kondolf . | |
| 2,878,983 | 3/1959 | Dulaney . | |
| 3,516,594 | 6/1970 | Stenzel et al. | 229/114 |
| 3,805,169 | 4/1974 | Meyers | 229/902 |
| 4,208,007 | 6/1980 | Bamburg et al. | 229/114 |
| 4,331,238 | 5/1982 | Hanko et al. . | |
| 4,441,626 | 4/1984 | Hall . | |
| 4,930,681 | 6/1990 | Fultz et al. . | |
| 5,121,876 | 6/1992 | Johnson | 229/149 |
| 5,269,457 | 12/1993 | De La Fuente | 229/149 |
| 5,431,333 | 7/1995 | Lorenz | 229/114 |
| 5,713,509 | 2/1998 | Correll . | |
| 5,799,864 | 9/1998 | Mertz | 229/149 |
| 5,833,130 | 11/1998 | Correll | 229/906 |

*Primary Examiner*—Gary E. Elkins
*Attorney, Agent, or Firm*—Flynn, Thiel, Boutell & Tanis, P.C.

[57] ABSTRACT

A food container formed from a foldable blank of corrugated cardboard into a box-like configuration for transport of a food product therein such as pizza. The food container includes upper and lower portions which are swingable towards and away from one another to define closed and open configurations of the box. The lower portion of the container has a generally planar bottom wall from which a pair of elongate side walls and front and rear side walls fold upwardly and angle outwardly relative thereto. The angled orientation of the side walls permits nesting of partially assembled containers one within the other in a vertically stacked configuration. The upper portion of the container includes a generally planar top wall from which a pair of side walls fold downwardly along side edges thereof. Each of these side walls includes an outwardly projecting locking tab which engages within a correspondingly located rear slot formed in the lower portion. The upper portion further includes a frontwardly oriented side wall which folds downwardly from the top wall, which side wall includes a pair of additional locking tabs projecting outwardly from each end thereof, which locking tabs engage with a front pair of slots formed in the lower portion.

15 Claims, 6 Drawing Sheets

STACKABLE, FOLDABLE FOOD CONTAINER

FIELD OF THE INVENTION

This invention relates to an improved food container assembled from a foldable blank and designed specifically for transport of a food product such as pizza or other food items.

BACKGROUND OF THE INVENTION

Many food containers are known which are preassembled and preglued to a defined three-dimensional shape. Such containers, however, are bulky for both shipment and storage, and thus are not desired in many use applications, such as for carry-out pizza.

Various types of foldable blanks are also known which are used to create a box or other suitable support for packaging and carrying food products such as pizza. Prepared ready-to-eat pizza and other food items for take-out or delivery are often packaged in a square box formed from such a foldable blank, which boxes typically have an attached openable lid or cover. Use of flat blanks which are easily assembled without glue or adhesive, which can be easily and compactly stored, and which can be easily assembled at the use site, is thus highly preferred in many use situations.

Many take-out or pizza establishments pre-fold or set up food boxes prior to usage in order to save time during busy periods. As a result, a typical pizzeria can have a large number of set up boxes within the store, which consumes considerable storage space. As such, boxes which are capable of being nested one within the other and stacked are known, such as those disclosed in U.S. Pat. Nos. 1,725,524 and 5,713,509. For example, the box illustrated in U.S. Pat. No. 1,725,524 has side walls which, when assembled, have a tapered configuration for permitting vertical stacking of the boxes within one another. These known arrangements, however, either do not possess a structure which provides the necessary rigidity and structural integrity when assembled and subsequently transported and/or possess a structure more complex and hence more expensive than desired.

More specifically, many food containers which are formed and folded from flat blanks utilize blanks which are of thin paperboard and thus are quite flexible, and hence can be partially prefolded and still partially nest when stacked due to the flexibility of the board. These containers, however, are relatively weak, possess less than desired rigidity, and do not possess desired thermal or moisture absorbing properties for optimum use with hot food products. Because of these disadvantages, many food containers and particularly pizza boxes are formed and folded from flat blanks of corrugated cardboard, typically double faced corrugated cardboard, because of the strength, rigidity and other desired physical properties thereof. The stiffness of these corrugated blanks, however, has prevented most such containers from being nested in an assembled condition, thereby requiring a large storage space for the preassembled containers.

Accordingly, it is an object of the invention to provide an improved food container for supporting a food product such as pizza, which food container is formed by being folded from a corrugated cardboard flat blank and when partially folded or assembled is capable of being nested so as to conserve space during storage thereof, and which container is stable and has improved rigidity to allow for safe handling and transport of the food product therein.

More specifically, the improved food container, in accordance with one aspect of the invention, includes upper and lower portions joined to one another such that the upper portion is pivotable away from and toward the lower portion to respectively define open and closed configurations of the container. The lower portion includes a generally horizontally enlarged and planar bottom wall having a pair of generally parallel first side edges and a pair of second side edges extending generally perpendicularly relative to the first side edges. First and second elongate side walls are integrally joined to the bottom wall and fold upwardly about the first side edges, and angle outwardly relative to the bottom wall. A front flap extends outwardly from a front end of each side wall, and a rear flap extends outwardly from a rear end of each side wall. Each front and rear flap is folded about respective front and rear fold lines which form an angle greater than 90° relative to a corresponding one of the first side edges to define front and rear corners of the bottom portion. A rear slot is disposed adjacent each rear corner, and a front slot is disposed adjacent each front corner. The lower portion includes front and rear side walls which are integrally joined to the bottom wall and fold upwardly about the second side edges. The front and rear side walls are angled outwardly relative to the bottom wall. The upper portion includes a generally planar top wall having a pair of generally parallel first side edges and a pair of generally parallel second side edges extending generally perpendicularly relative to the first top wall side edges. Upper portion also includes first and second elongate side walls integrally joined to the top wall and folded therefrom about fold lines which extend along the top wall first side edges. Each first and second top wall side wall has a locking tab which extends outwardly from an end thereof adjacent the rear side wall, each for engagement within a corresponding one of the rear slots in the closed configuration of the container. The top wall is integrally joined to the rear side wall and pivotable with respect thereto. Upper portion further includes a third elongate side wall integrally joined to the top wall and folded therefrom about a fold line which extends along the other of the top wall second side edges. The third side wall has a pair of locking tabs extending outwardly from opposite ends thereof, each for engagement within a corresponding one of the front slots.

Another aspect of the invention resides in a food container having upper and lower portions whereby the lower portion includes a planar bottom wall having a pair of generally parallel first side edges and a pair of generally parallel second side edges extending generally perpendicular relative to the first side edges, and first and second elongate side walls integrally joined to the bottom wall and folded upwardly therefrom about fold lines which extend along the first side edges. The lower portion also includes front and rear side walls integrally joined to the bottom wall and folded upwardly therefrom about fold lines which extend along a respective one of the second side edges. The first and second side walls and also the front and rear side walls are oriented at an interior angle greater than 90° with respect to the bottom wall to enable vertical stacking of a plurality of assembled but open containers one atop the other. Further, opposite ends of the rear side wall, along with adjacent rear ends of each of the first and second side walls form a pair of rear corners of the container, and opposite ends of the front side wall along with adjacent front ends of the first and second side walls form a pair of front corners of the container. The lower portion additionally includes a pair of upwardly opening slots, each disposed adjacent a respective one of the front corners. The upper portion of the container includes a generally planar top wall having a first pair of parallel side edges and a second pair of generally parallel side edges extending generally perpendicularly relative to the first pair of top wall side edges. The top wall is integrally joined to the rear side wall about a fold line which extends along one of the first top wall side edges, and an elongate side wall is integrally joined to the top wall and folded therefrom about a fold line which extends along the other of the first top wall side edges. The top wall side wall has a pair of locking tabs extending outwardly from opposite ends thereof each for engagement within one of the slots in the closed configuration of the container.

Other objects and purposes of the invention will be apparent to persons familiar with arrangements of this general type upon reading the following specification and inspecting the accompanying drawings.

Figure 1:
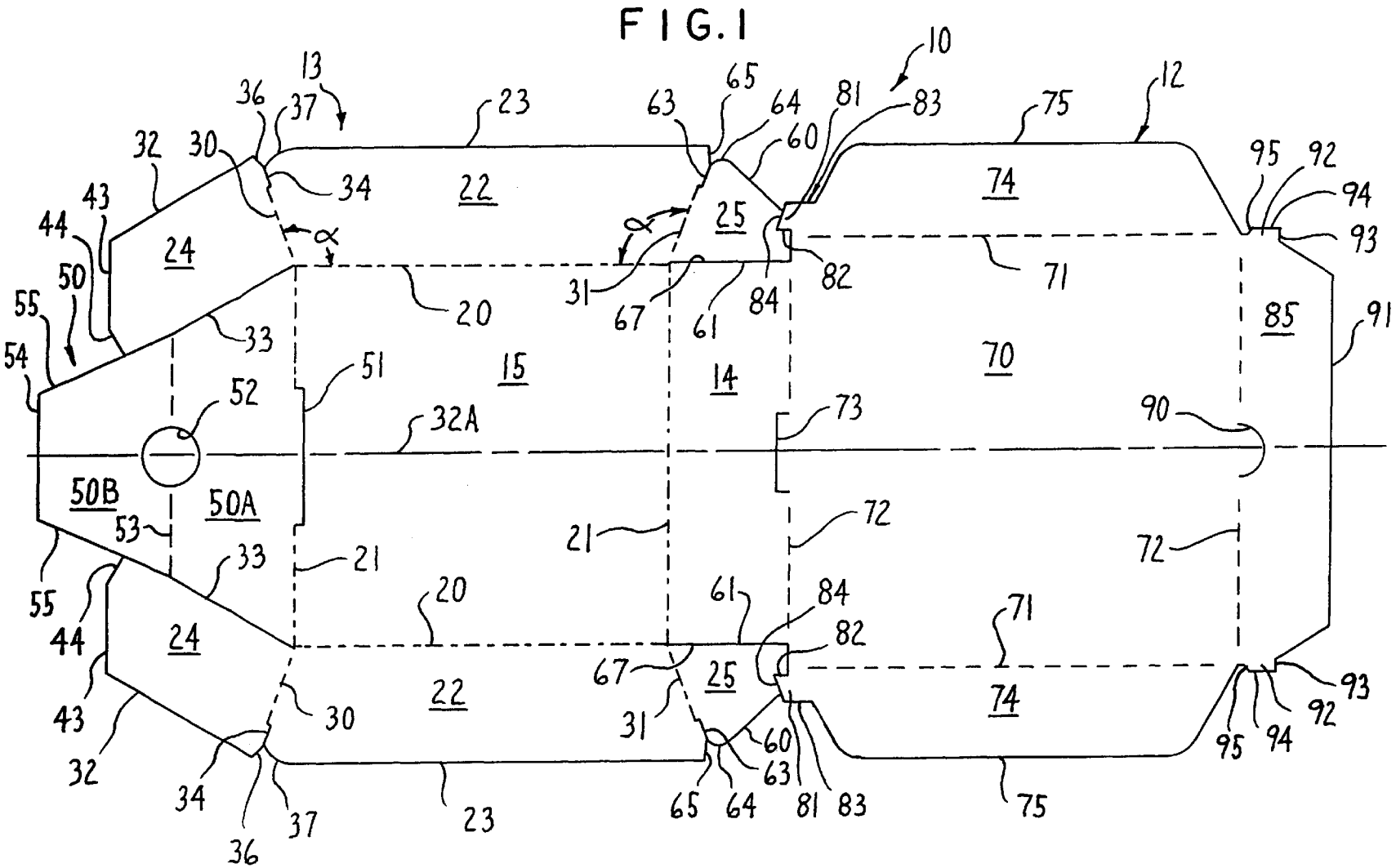
FIG. 1 is a plan view of an unfolded flat blank according to the present invention.

Certain terminology will be used in the following description for convenience in reference only, and will not be limiting. For example, the words "upwardly", a "downwardly", "rightwardly" and "leftwardly" will refer to directions in the drawings to which reference is made. The words "inwardly" and "outwardly" will refer to directions toward and away from, respectively, the geometric center of the container or blank and designated parts thereof. Said terminology will include the words specifically mentioned, derivatives thereof, and words of similar import.

DETAILED DESCRIPTION

Referring to FIG. 1, the present invention is directed to a flat blank 10 preferably constructed from stiff double-sided corrugated cardboard having a corrugated interior layer bonded between a pair of flat facing layers, which layers are all of rather thin paper. However, the blank 10 may also be constructed of single-sided corrugated cardboard having a corrugated layer bonded to a single flat facing layer, with the corrugated layer facing inwardly toward the food product. The blank 10 is prepared using techniques which are conventional and well known in the box forming industry.

Figure 4:
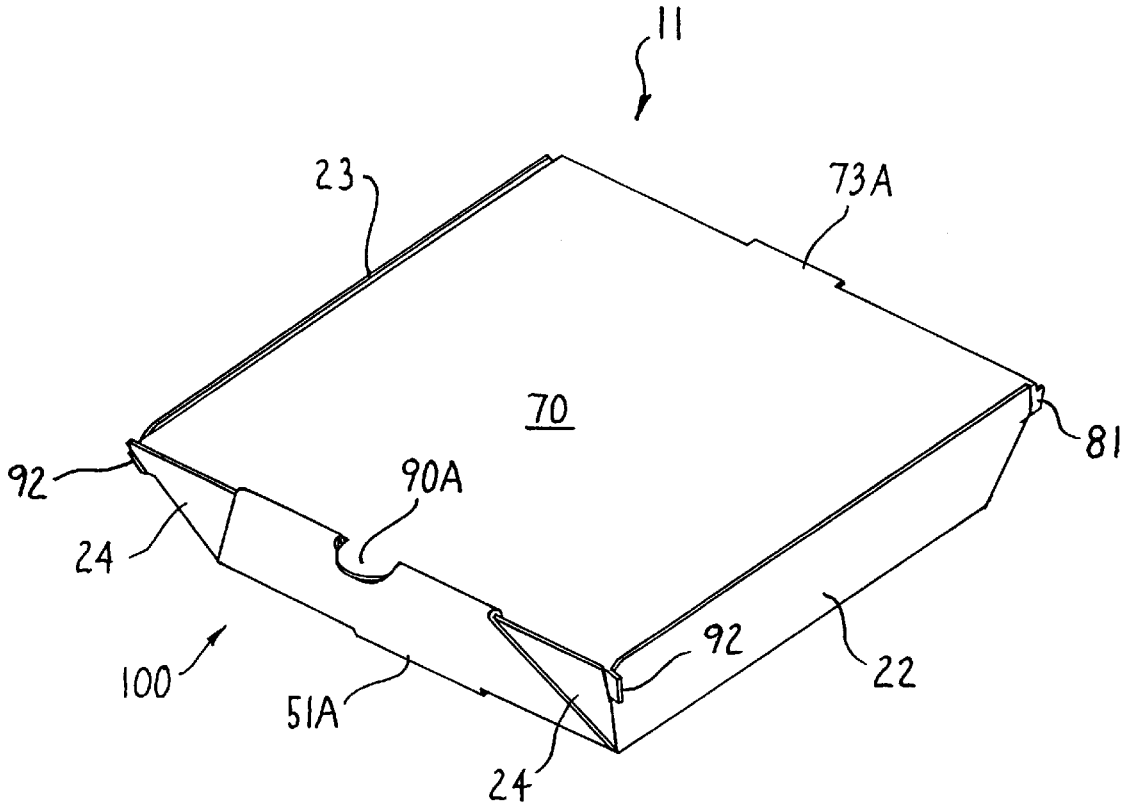
FIG. 4 is an overhead perspective view of the container in a closed configuration.

The blank 10 is foldable into the shape of a box or container 11 (FIG. 4) suitable for carrying a food product, such as pizza. The container 11 includes upper and lower portions 12 and 13 (FIG. 2) which are joined together by a rear base portion 14 so as to permit closure of the container 11 and creation of a closed compartment therein.

The blank 10 (FIG. 1) is a flat and generally planar, monolithic, one-piece element and defines a bottom wall 15 which forms part of the lower portion 13 and has the general shape of a square. The bottom wall 15 and includes a pair of generally parallel first side edges 20 and a pair of generally parallel second side edges 21, the latter extending generally perpendicularly between the side edges 20. All of the side edges 20 and 21 are defined by fold lines shown in dotted lines in FIG. 1.

The blank 10 also includes a pair of elongate side wall parts 22 which join to opposite side edges 20 at the fold lines thereof. A free edge 23 of each side wall part 22 extends generally parallel with the side edge or fold line 20, the latter defining the inner or lower edge of the side wall part 22. The blank 10 further includes a pair of additional front and rear wall parts 24 and 25 which effectively function as flaps and which project or extend outwardly in cantilevered relationship from opposite ends of a respective side wall part 22. Each flap 24 and 25 is joined to an end of the respective side wall part 22 through fold lines 30 and 31, respectively. Each fold line 30 and 31 extends substantially throughout the width of the side wall part 22 and intersects the fold line 20 at an angle $\alpha$ greater than 90°. Angle $\alpha$ is preferably between about 100° and about 120°, and in the illustrated embodiment has a value of about 110°. The fold lines 30 and 31 intersect at the point of intersection of the fold lines 20 and 21, and in the assembled condition of container 11, the fold lines 30 and 31 respectively define front and rear corners of container 11.

The flap 24 is defined by a pair of generally parallel outer and inner free edges 32 and 33, both of which are substantially perpendicular to fold line 30 and angle inwardly towards a reference plane 32A which perpendicularly intersects bottom wall 15 in parallel relationship with side edges 20. A cut line 34, adjacent outer free edge 32, partially separates flap 24 from the respective side wall part 22. The cut line 34, along with recessed or tapered edges 36 and 37 of the flap 24 and side wall part 22 as defined at the adjacent outer corners of the flaps 24 and the respective side wall part 22, define an upwardly opening slot 35 (FIG. 2) when the lower portion 13 of blank 10 is assembled.

Flap 24 is further defined by forward free edges 43 and 44. Free edge 43 extends substantially parallel to side edges 21, and free edge 44 is substantially parallel to fold line 30.

Blank 10 further includes a front flap 50 generally having the shape of a truncated triangle. Flap 50 joins to the front side of bottom wall 15 at the fold line 21. A cut line 51 in the shape of a partial rectangle is located approximately centrally along front side edge 21, and when front flap 50 is folded upwardly along fold line 21 as discussed below, cut line 51 results in formation of a tab 51A and a slot 51B adjacent front fold line 21. Front flap 50 includes a circular cut-out or opening 52, and a fold line 53 generally bisects opening 52 and extends generally parallel to side edges 21 and divides flap 50 into inner and outer flap portions 50A and 50B. Flap 50 has a periphery defined by a forward free edge 54 oriented substantially parallel to side edge 21, and a pair of side edges 55. Each side edge 55 is partially defined by a cut line which separates front flap 50 from the respective flap 24 and defines the innermost free edges 33 thereof. Forward free edge 54 preferably has a width similar to the length of cut line 51.

Figure 2:
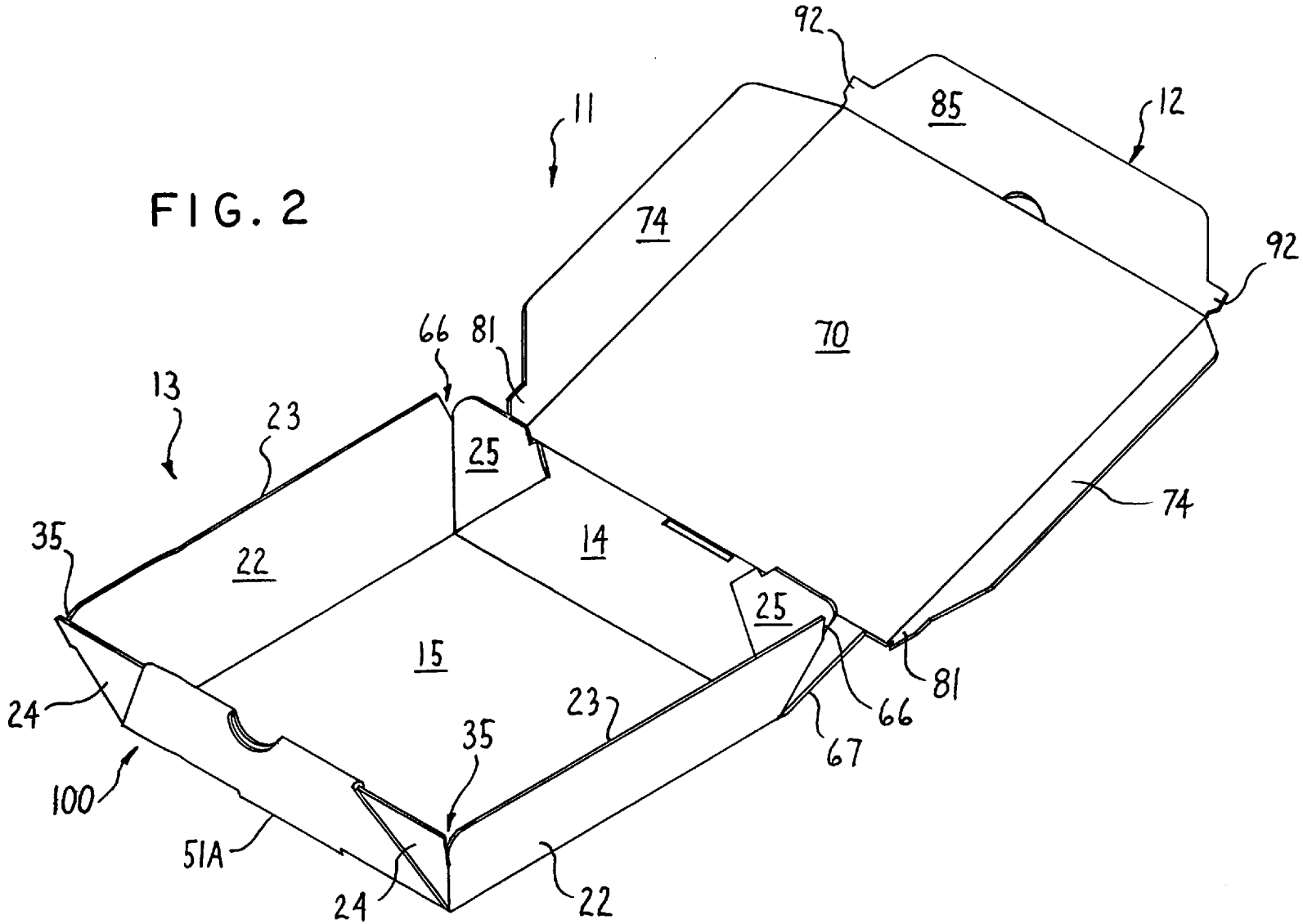
FIG. 2 is an overhead perspective view of an assembled container formed from the blank of FIG. 1 in an open configuration.
Figure 7:
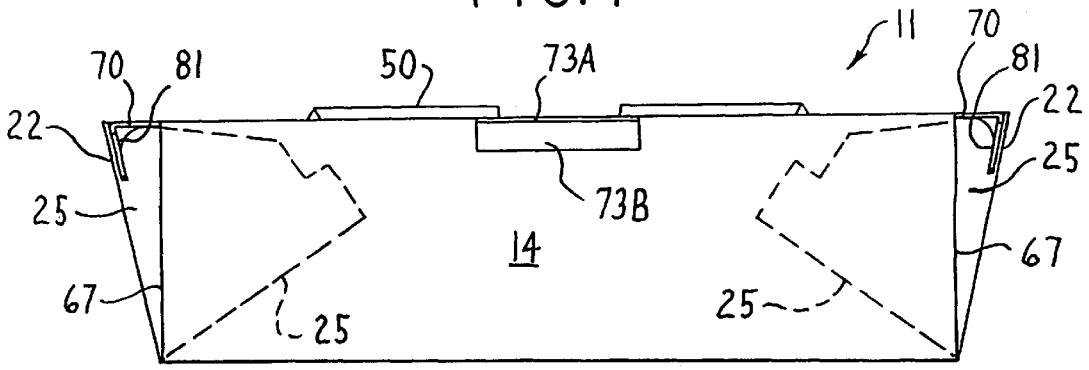
FIG. 7 is a rear view of the closed container.
Figure 8:
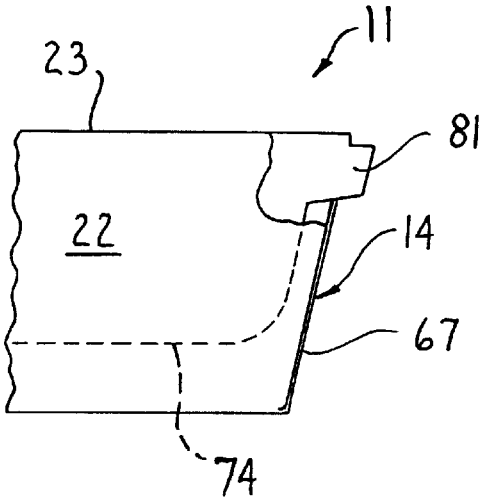
FIG. 8 is a fragmentary view similar to FIG. 5.
Figure 9:
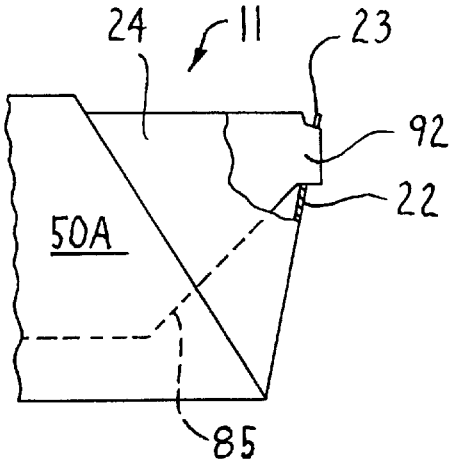
FIG. 9 is a fragmentary view similar to FIG. 6.

Rear flaps 25 are defined by an outermost or top free edge 60 which angles inwardly toward reference plane 32A, and an inner or bottom free edge 61. A cut line 63 partially separates flap 25 from side wall part 22, and along with tapered or recessed edges 64 and 65 of flap 25 and side wall part 22, forms an upwardly operating slot 66 (FIG. 2) similar to slot 35 when the blank 10 is assembled. Bottom free edge 61 is defined by a cut line which separates the respective flap 25 from base portion 14 and also defines the free edge 67 thereof (FIGS. 2 and 7).

Rear base portion 14 is preferably rectangular in configuration and adjoins bottom wall 15 through rear fold line 21.

The upper portion 12 of blank 10 is embodied by a top wall 70 having a generally square configuration. Top wall 70 is somewhat larger than bottom wall 15 and includes a pair of generally parallel first side edges 71 and a pair of generally parallel second side edges 72, the latter extending generally perpendicularly between the side edges 71. Side edges 71 and 72 are defined by fold lines shown in dotted lines in FIG. 1 and are generally parallel to the respective side edges 20 and 21 of bottom wall 15. Rear base portion 14 adjoins top wall 70 through side edge (i.e. fold line) 72, and a cut line 73 in the form of a partial rectangle is disposed within rear base portion 14 approximately centrally along fold line 72. When the top portion 12 is folded along fold line 72 adjacent base portion 14, cut line 73 results in a tab 73A and an elongate slot-like opening 73B (FIG. 7).

Blank 10 additionally includes a pair of elongate side wall parts 74 which form part of upper portion 12 and which join to opposite side edges 71 at the fold lines thereof. A substantial portion of each free edge 75 of side wall parts 74 is generally parallel with the side edge or fold line 71, the latter defining the inner edge of the side wall part 74. Free edge 75 angles inwardly towards reference plane 32A at each end of the respective side wall part 74. At the end of the side wall part 74 adjacent the base portion 14, a nonlinear cut line separates side wall part 74 and top wall 70 from rear flap 25, and substantially defines a locking tab 81 on side wall part 74. Locking tab 81 projects outwardly toward the corner flap 25 and includes inner and outer edges 82 and 83, both of which are substantially parallel to side edge 71, and a forward edge 84 which extends angularly between edges 82 and 83.

Figure 6:
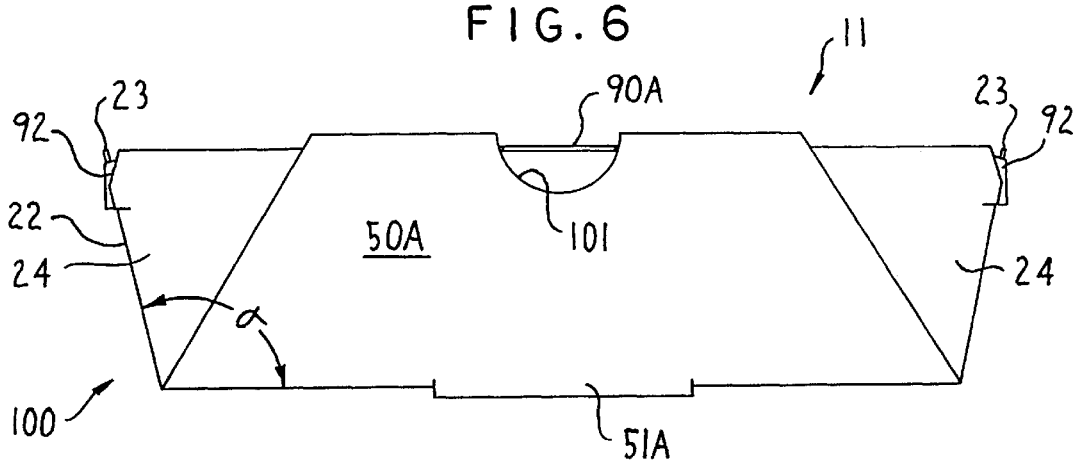
FIG. 6 is a front view of the closed container.

Blank 10 includes an additional side wall part 85 which joins to side edge 72 of top wall 70 through the fold line thereof. A semi-circular cut line 90 is formed within side wall part 85 and forms a semi-circular tab 90A which extends outwardly from side edge 72 when the blank 10 is assembled (FIG. 6). Side wall part 85 has an outer free edge 91 oriented generally parallel to side edges 72. Free edge 91 angles outwardly and away from reference plane 32A at each end of side wall part 85, and terminates at a locking tab 92 formed at each end thereof. The locking tab 92 is defined by a pair of generally perpendicular and adjoining edges 93 and 94, with edge 94 being generally parallel to side edges 71. Tab 92 also includes a shoulder 95 which angles inwardly from edge 94 towards reference plane 32A and adjoins wall part 85 adjacent side edge 72.

Locking tabs 81 and 92 are sized so as to fit within slots 66 and 35, respectively, as discussed below.

The blank 10 will normally be maintained in the flat condition illustrated by FIG. 1, which facilitates compact shipping and storage thereof. When use is desired, the blank 10 may be assembled for the purpose of stacking and nesting a number of containers 11 atop one another in readiness for use as discussed below, and then folded into a closed position for storage and transport of a food product placed therewithin.

Figure 10:
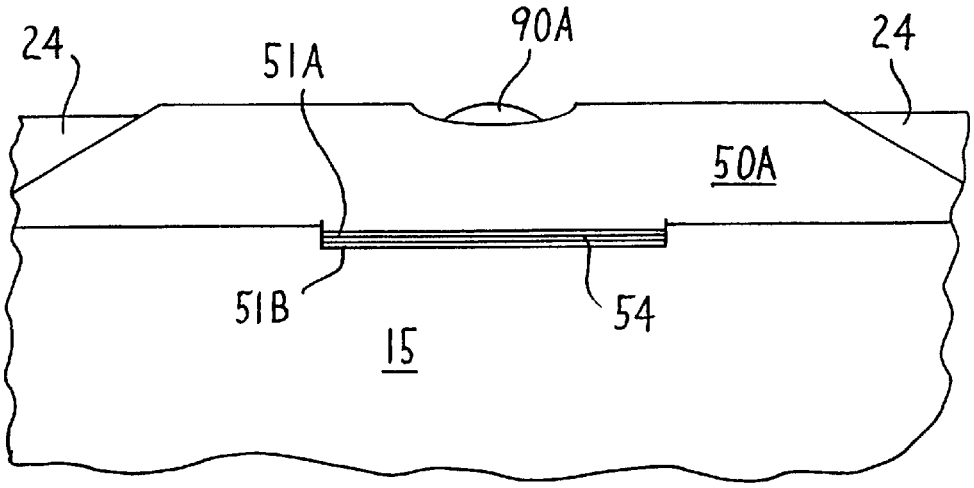
FIG. 10 is an enlarged, fragmentary bottom view of the container.

To partially assemble the container 11 for purposes of stacking a plurality of such containers 11 in the nested relationship, the side wall parts 22 are initially manually folded upwardly about fold lines 20, and at about the same time the flaps 24 and 25 are folded inwardly and towards one another about the respective fold lines 30 and 31. The flaps 24 are then folded further inwardly until the edges 33 thereof lie substantially along and engage front side edge 21 and edges 44 thereof substantially meet and abut one another. The front flap 50 is then folded upwardly about fold line 21 and towards the respective flaps 24. The outer portion 50B of flap 50 is then folded downwardly about fold line 53 and the edge 54 thereof tucked into the slot 51B (FIG. 10) formed by cut line 51. Thus, the flap 50 wraps around flaps 24, and along therewith forms a rigid front wall 100 of the container 11 (FIGS. 2 and 6).

Figure 3:
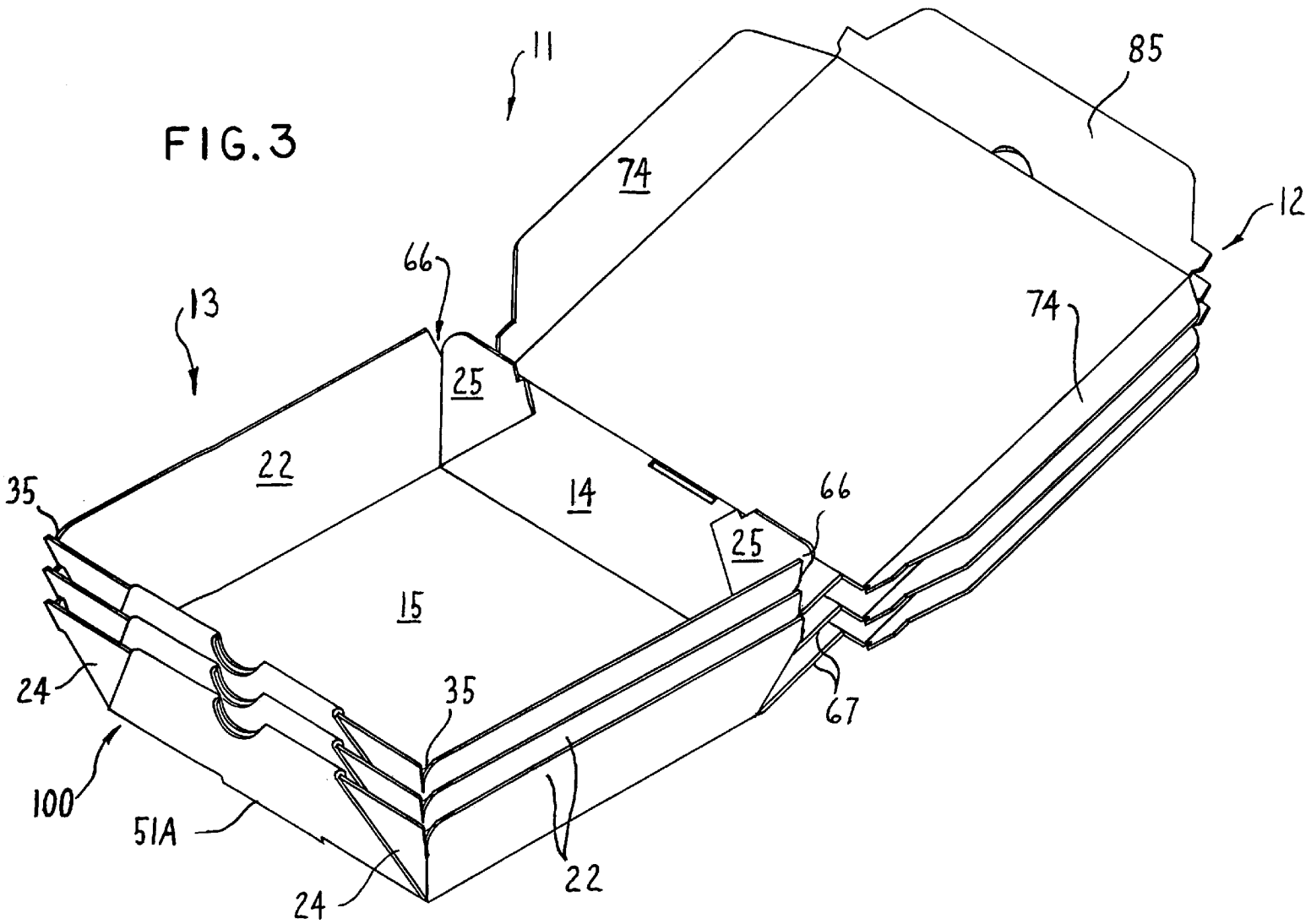
FIG. 3 shows a plurality of open, assembled containers in a nested or vertically stacked configuration.
Figure 5:
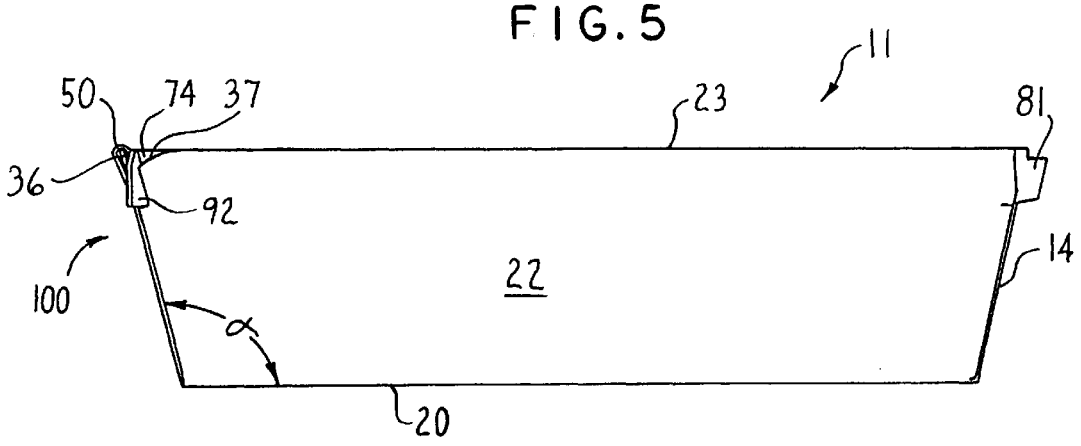
FIG. 5 is a right side view of the closed container.

The container 11 is now in a partially assembled condition as shown in FIG. 2, and due to the angled arrangement of the flaps 24 and 25 with respect to the respective side wall parts 22, the side walls 22 and front wall 100 in their assembled positions taper outwardly and upwardly from bottom wall 15, and therefore enable a number of containers 11 to be stacked in a vertically nested manner one atop the other (FIG. 3). In this regard, front wall 100 is oriented substantially at angle $\alpha$ with respect to bottom wall 15 (FIG. 5). Further, side wall parts 22 are oriented at an angle $\alpha$ with respect to bottom wall 15 (FIG. 6).

In this partially assembled condition, a food product may be placed on the bottom wall 15 of the uppermost container 11, and the container 11 may then be removed to a more convenient location for further assembly, or alternatively left atop the stack and further assembled thereat.

To complete assembly or closure of the container 11, with flaps 25 in a partially folded configuration, the base portion 14 is folded upwardly about fold line 21 which serves to push flaps 25 further inwardly. As the base portion 14 is folded upwardly, the upper portion 12 is swung upwardly and is folded about the fold line 72, and substantially simultaneously therewith side wall parts 74 are folded inwardly about their fold lines 71 until rear locking tabs 81 are aligned with the respective slots 66. Continued downward swinging movement of the upper portion 12 orients base portion 14 approximately at angle $\alpha$ with respect to bottom wall 15, and rear locking tabs 81 are pushed further into the respective slots 66, with the side wall parts 74 simultaneously sliding against the inner surfaces of the respective side wall parts 22 of lower portion 13.

To completely close the container 11, the side wall part 85 of upper portion 12 is folded downwardly or inwardly about the fold line 72, and the free edge 91 thereof is tucked inside the front wall 100 to align front locking tabs 92 with the respective slots 35. Continued movement of the upper portion 12 downwardly pushes rear locking tabs 81 completely within slots 66 until the edge 83 of each locking tab 81 abuts the bottom of the respective slot 66. Shortly thereafter, locking tabs 92 are pushed into slots 35 until the edge 93 thereof abuts the bottom of the respective slot 35. FIGS. 4–7 illustrate the container 11 in the fully closed condition, and ready for transport.

The engagement of the locking tabs 81 and 92 in the respective slots 66 and 35 provide the assembled container 11 with a rigid configuration which enables safe transport of the food items stored therein. As such, the containers 11 may be safely stacked vertically upon one another in the fully assembled and closed condition for storage of food items prior to delivery, and also during delivery.

As best shown in FIG. 6, the opening 52 of front flap 50, in the assembled configuration, forms a semi-circular recess 101 in front wall 100. Further, tab 90A aligns with recess 101 and facilitates easy opening of the container 11 which is achieved by placing a finger within recess 101 and pulling upwardly on the tab 90A.

The container of this invention can thus be shipped and stored as a flat blank, can then be partially assembled without glue or adhesive at the use site to permit compact stackable nesting in an open condition so that such containers occupy very little space and yet are in a condition for use, and then are readily useable by permitting placement of a pizza or food product therein, followed by easily manual closure of the container.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A food container comprising:

upper and lower portions joined to one another such that said upper portion is pivotable away from and toward said lower portion to respectively define open and closed configurations of said container;

said lower portion of said container including:

(a) a generally horizontally enlarged and planar bottom wall having a first pair of generally parallel side edges and a second pair of side edges extending generally perpendicularly relative to said first pair of side edges;

(b) first and second elongate side walls integrally joined to said bottom wall and folded upward therefrom about generally horizontal fold lines which extend along said first pair of side edges, said side walls projecting generally upwardly from said bottom wall and being angled outwardly relative thereto;

(c) a front pair of flaps each extending outwardly from a front end of a respective said side wall and a rear pair of flaps each extending outwardly from a rear end of a respective said side wall opposite said front end thereof, each said flap being integrally joined to the respective said side wall and extending inwardly toward a central plane that perpendicularly intersects a center of said bottom wall and extends parallel to said first pair of side edges, each said front and rear flap being folded about respective front and rear fold lines which form an angle greater than 90° relative to a corresponding one of said first pair of side edges to respectively define front and rear pairs of corners of said bottom portion;

(d) a rear pair of slots each disposed adjacent one of said rear corners and a front pair of slots each disposed adjacent one of said front corners; and (e) front and rear side walls integrally joined to said bottom wall and folded upwardly therefrom about generally horizontal fold lines which extend along a respective one of said second pair of side edges, said front and rear side walls projecting generally upwardly from said bottom wall and being angled outwardly relative thereto, said front pair of flaps lying closely adjacent said front side wall and said rear pair of flaps lying closely adjacent said rear side wall;

said upper portion of said container including:

(a) a generally planar top wall having a first pair of generally parallel side edges and a second pair of generally parallel side edges extending generally perpendicularly relative to said first pair of top wall side edges, said first pair of top wall side edges being generally parallel to said first pair of bottom wall side edges;

(b) first and second elongate side walls integrally joined to said top wall and folded therefrom about fold lines which extend along said first pair of top wall side edges, each of said first and second top wall side walls having a locking tab extending outwardly from an end thereof adjacent said rear side wall each for engagement within a corresponding one of said rear pair of slots when said container is in said closed configuration;

(c) said top wall being integrally joined to said rear side wall and pivotable with respect thereto about a fold line which extends along one of said second top wall side edges; and (d) a third elongate side wall integrally joined to said top wall and folded therefrom about a fold line which extends along the other of said second top wall side edges, said third side wall having a pair of locking tabs extending outwardly from opposite ends thereof each for engagement within a corresponding one of said front pair of slots when said container is in said closed configuration.

2. The container of claim 1 wherein said container is formed in its entirety from a one-piece, monolithic, flat, sheet-like blank of stiff cardboard.

3. The container of claim 1 wherein said pair of front slots open upwardly and are defined generally along respective ones of said front fold lines, and said pair of rear slots open upwardly and are defined along respective ones of said rear fold lines.

4. The container of claim 3 wherein said container is formed in its entirety from a one-piece, monolithic, flat, sheet-like blank of stiff cardboard.

5. The container of claim 3 wherein said front pair of slots are each defined by a recessed edge of said first and second side walls at said front ends thereof and an opposed recessed edge of the respective said front flap adjacent the corresponding said front fold line, and said rear pair of slots are each defined by a further recessed edge of said first and second side walls at said rear ends thereof and an opposed recessed edge of the respective said rear flap adjacent the corresponding said rear fold line.

6. The container of claim 1 wherein said front side wall is divided by a generally horizontal front fold line into first and second portions, said first portion being integrally joined to said bottom wall at one edge thereof through said one second side edge and joined to said second portion through said front fold line at an opposite edge thereof, said second portion being folded downwardly along said front fold line such that said second portion wraps around free ends of said front flaps and lies in juxtaposed relation to said first portion with said front flaps confined therebetween.

7. The container of claim 1 wherein said angle of said front and rear fold lines is between about 100° and about 120° to permit vertical nesting of a plurality of said containers one atop the other in said open configuration.

8. A food container comprising:

upper and lower portions joined to one another such that said upper portion is pivotably swingable away from said lower portion to define an open configuration of said container and toward said lower portion to define a closed configuration of said container;

said lower portion including:

a planar bottom wall having a first pair of generally parallel side edges and a second pair of generally parallel side edges extending generally perpendicular relative to said first pair of side edges;

first and second elongate side walls integrally joined to said bottom wall and folded upwardly therefrom about fold lines which extend along said first pair of side edges;

front and rear side walls integrally joined to said bottom wall and folded upwardly therefrom about fold lines which extend along a respective one of said second pair of side edges;

said first and second side walls and said front and rear side walls all being disposed at an angle greater than 90° with respect to said bottom wall such that a plurality of said containers, when in said open configuration, are vertically stackable in nested relation one atop the other;

opposite ends of said rear side wall along with adjacent rear ends of said first and second side walls forming a pair of rear corners of said container, and opposite ends of said front side wall along with adjacent front ends of said first and second side walls forming a pair of front corners of said container;

a pair of upwardly opening front slots, each said slot being disposed adjacent a respective one of said front corners; said upper portion including:

a generally planar top wall having a first pair of generally parallel side edges and a second pair of generally parallel side edges extending generally perpendicularly relative to said first pair of top wall side edges;

said top wall being integrally joined to said rear side wall about a fold line which extends along one of said first top wall side edges;

an elongate side wall integrally joined to said top wall and folded therefrom about a fold line which extends along the other of said first top wall side edges, said top wall side wall having a pair of locking tabs extending outwardly from opposite ends thereof each for engagement within one of said front slots in said closed configuration of said container.

9. The container of claim 8 wherein said container is formed in its entirety from a one-piece, monolithic, flat, sheet-like blank of stiff cardboard.

10. The container of claim 8 wherein a pair of upwardly opening rear slots are disposed adjacent respective ones of said rear corners, and said upper portion further includes a pair of additional elongate side walls integrally joined to said top wall and folded therefrom about fold lines which extend along said second top wall side edges, each said additional top wall side wall having a locking tab extending outwardly from an end thereof adjacent said rear side wall for engagement within one of said rear slots in said closed configuration of said container.

11. The container of claim 8 wherein said lower portion further includes a front pair of flaps each extending outwardly from respective front ends of said first and second side walls, and a rear pair of flaps each extending outwardly from respective rear ends of said first and second side walls, each said front and rear flap being integrally joined to the respective said first and second side walls and being folded about respective front and rear fold lines which respectively define one of said front and rear corners, said front flaps forming part of said front side wall and said rear flaps lying closely adjacent said rear side wall when the container is in the closed configuration.

12. The container of claim 11 wherein each said front slot extends along a respective one of said fold lines defining said front corners.

13. The container of claim 12 wherein said container is formed in its entirety from a one-piece, monolithic, flat, sheet-like blank of stiff cardboard.

14. The container of claim 11 wherein said front and rear fold lines form an angle greater than 90° relative to a corresponding one of said first pair of side edges to respectively define said front and rear pairs of corners.

15. The container of claim 11 wherein said front side wall is divided by a generally horizontal front fold line into first and second portions, said first portion being integrally joined to said bottom wall at one edge thereof through said one second side edge and joined to said second portion through said front fold line, said second portion being folded downwardly along said front fold line such that said second portion wraps around free ends of said front flaps and lies in juxtaposed relation to said first portion with said front flaps confined therebetween.

* * * * *